US007346990B2

(12) United States Patent
Dirks et al.

(10) Patent No.: US 7,346,990 B2
(45) Date of Patent: Mar. 25, 2008

(54) ROTARY MOTOR CLIPPER WITH LINEAR DRIVE SYSTEM

(75) Inventors: Keith W. Dirks, Sterling, IL (US); Jon Freas, Sterling, IL (US); Robert N. Buck, Jr., Rock Falls, IL (US)

(73) Assignee: Wahl Clipper Corporation, Sterling, IL (US)

( * ) Notice: Subject to any disclaimer, the term of this patent is extended or adjusted under 35 U.S.C. 154(b) by 346 days.

(21) Appl. No.: 10/929,531

(22) Filed: Aug. 30, 2004

(65) Prior Publication Data

US 2006/0042093 A1 Mar. 2, 2006

(51) Int. Cl.
*B26B 19/02* (2006.01)

(52) U.S. Cl. ..... 30/210; 30/220

(58) Field of Classification Search ..... 30/194, 30/196, 208, 195, 220, 43.91, 216
See application file for complete search history.

(56) References Cited

U.S. PATENT DOCUMENTS

| | | | | |
|---|---|---|---|---|
| 2,279,682 | A * | 4/1942 | Jackson | 30/43.6 |
| 2,510,844 | A | 6/1950 | Armbruster et al. | |
| 3,589,007 | A | 6/1971 | Walton | |
| 4,137,632 | A * | 2/1979 | Pfanzer | 30/393 |
| 4,383,366 | A | 5/1983 | Andis | |
| 5,068,966 | A * | 12/1991 | Wahl et al. | 30/43.2 |
| 5,088,200 | A * | 2/1992 | Piwaron et al. | 30/216 |
| 5,325,590 | A * | 7/1994 | Andis et al. | 30/216 |
| 5,606,799 | A * | 3/1997 | Melton | 30/216 |
| 6,076,263 | A | 6/2000 | Andis et al. | |
| 6,219,920 | B1 * | 4/2001 | Klein | 30/43.92 |

FOREIGN PATENT DOCUMENTS

| | | |
|---|---|---|
| EP | 0 147 134 A3 | 7/1985 |
| GB | 224852 | 5/1925 |
| JP | 54098857 | 8/1979 |
| JP | 2000107469 | 4/2000 |

* cited by examiner

*Primary Examiner*—Kenneth E. Peterson
*Assistant Examiner*—Sean Michalski
(74) *Attorney, Agent, or Firm*—Greer, Burns & Crain, Ltd.

(57) ABSTRACT

A hair clipper includes a motor with a rotary output shaft, a bladeset including a stationary blade and a moving blade configured for reciprocation relative to the stationary blade, a drive system configured for transferring motion from the output shaft to the bladeset, and including a driving member moving linearly along an axis transverse to a longitudinal axis of the clipper.

16 Claims, 5 Drawing Sheets

ROTARY MOTOR CLIPPER WITH LINEAR DRIVE SYSTEM

BACKGROUND OF THE INVENTION

The present invention relates generally to hair cutting devices having a bladeset including a moving blade reciprocating relative to a stationary blade and a drive system for powering the bladeset, and more specifically to hair clippers or trimmers used for cutting hair of humans or animals.

Conventional hair cutting devices using a rotary drive system, such as hair trimmers and clippers typically include a drive member powered by the output shaft of the motor. For the purposes of this application, the terms "hair cutting device", "hair clipper" and "hair trimmer" are considered interchangeable. The drive system converts rotary motion generated by the motor into linear motion in the form of the reciprocating moving blade relative to the stationary blade.

In most drive systems, a driving end of the drive member follows an arcuate or semi-arcuate path as it engages the moving blade of the bladeset. In this case, the term "semi-arcuate" refers to systems where at least part of the working stroke of the driving end follows an arcuate path. One such semi-arcuate conventional drive system employs a resilient parallelogram movement of the drive system. As such, the driving end moves in and out of engagement with the moving blade at least once during each revolution of the output shaft. In time, operational conditions, including heat and friction, combine to cause wear and deterioration of the driving end of the drive element. Such wear decreases operational efficiency of the clipper and often increases operational noise.

Another operational problem of conventional hair cutting devices is that hair clippings tend to accumulate in the area of the bladeset. The accumulation, which is more severe when the hair is wet, impedes the efficiency of the cutting device, since the unit does not move as quickly through the subject's hair. This condition also is more pronounced when clipping or shearing animal hair.

Still another operational problem of many conventional hair cutting devices is that the on/off switch is typically located on the top or side of the housing, where it is often accidentally actuated by the user during use. This may interfere with the cutting operation, especially when the operator is in the midst of styling, and prefers minimum interruption.

Thus, there is a need for a drive system for a hair cutting device which addresses the above-identified problems of conventional units.

BRIEF SUMMARY OF THE INVENTION

The above-listed needs are met or exceeded by the present hair cutting device which overcomes the limitations of the current technology. Among other things, the present cutting device is designed for linear movement of the drive element, which maintains a constant engagement with the moving blade. In contrast to conventional arcuate or semi-arcuate drive systems, the present system provides "true" linear motion of the drive element throughout its stroke as generated by rotation of the motor output shaft. In this application, "true" linear motion refers to the fact that a drive tip of the drive element does not move in or out, or up or down relative to the engagement with the moving blade of the bladeset. Instead, a constant relationship is maintained between the drive element throughout the linear reciprocating stroke of the moving blade. As such, wear of the drive element is reduced and operational life is increased. Another feature of the present hair clipper is that the housing is provided with a configuration shaped for reducing the accumulation of hair clippings in the bladeset area. A spheroidal shape promotes the escape of clippings from this area, thus facilitating the movement of the clipper through a subject's hair. Still another feature of the present hair clipper is the provision of a motor actuator switch handle projecting from an underside of the housing, preferably from a recess in the underside, for promoting more positive operator control of the unit.

More specifically, the present hair clipper includes a motor with a rotary output shaft, a bladeset including a stationary blade and a moving blade configured for reciprocation relative to the stationary blade, a drive system configured for transferring motion from the output shaft to the bladeset, and including a driving member moving linearly along an axis transverse to a longitudinal axis of the clipper.

In another embodiment, a hair clipper includes a motor with a rotary output shaft, a bladeset including a stationary blade and a moving blade configured for reciprocation relative to the stationary blade, a drive system configured for transferring motion from the output shaft to the bladeset and a housing enclosing the motor and at least a portion of the drive system. The housing is provided with a spheroidal shape adjacent the bladeset for promoting flow of cut hair away from the bladeset.

DETAILED DESCRIPTION OF THE INVENTION

Figure 1:
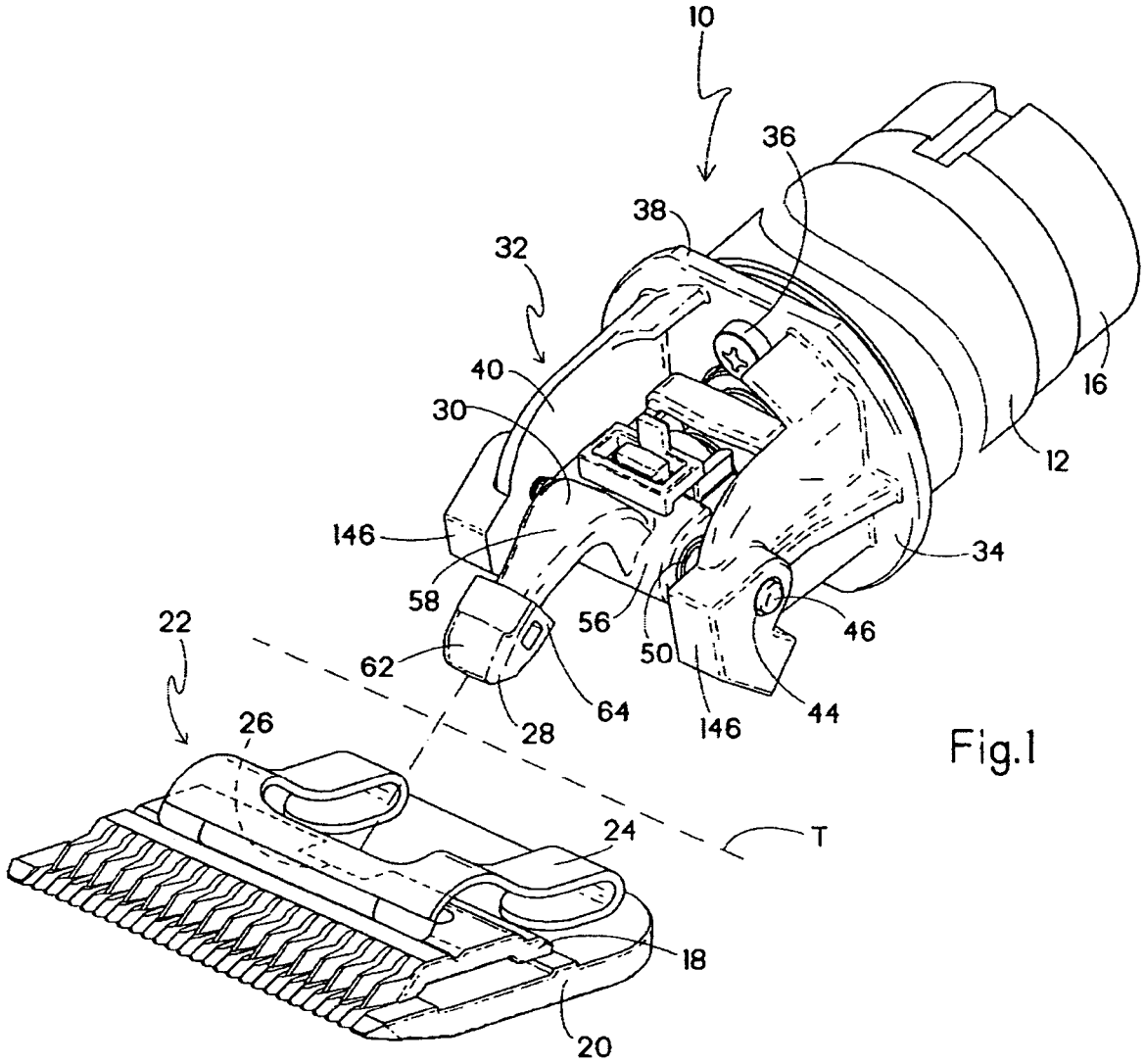
FIG. 1 is a fragmentary exploded perspective view of the present hair clipper drive system.
Figure 2:
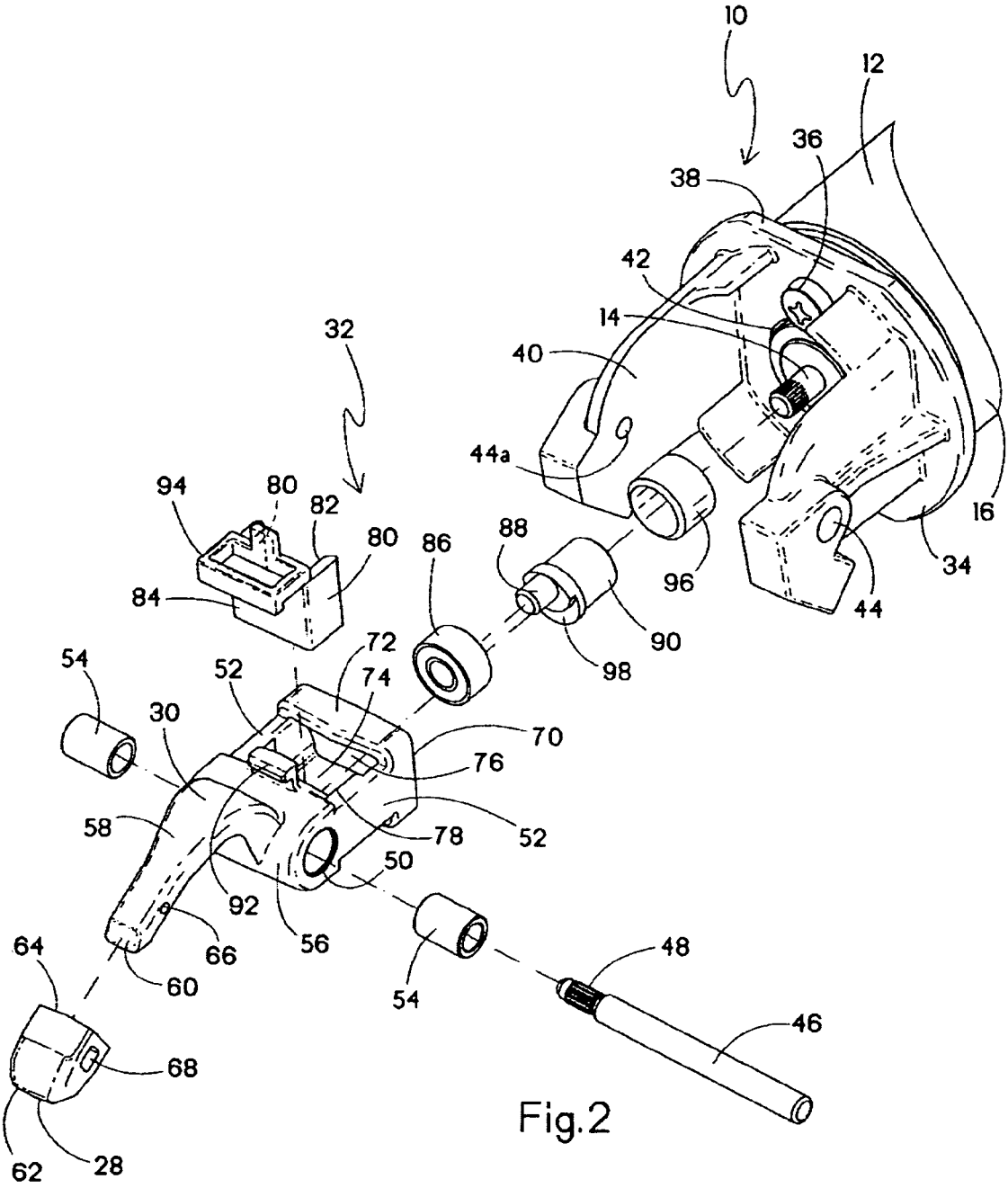
FIG. 2 is an exploded perspective view of the present drive system.

Referring now to FIGS. 1 and 2, a hair clipper suitable for use with the present drive system is generally designated 10, and includes a motor 12, typically an electric motor powered by battery or line voltage. It will be appreciated that the size and/or type of the motor may vary to suit the application. The motor 12 is designated as a rotary type, having an output shaft 14 (FIG. 2) projecting axially from a motor housing 16. As is well known in the art, rotation of the output shaft 14 must be translated into linear motion in the form of linear reciprocation of a moving blade 18 relative to a stationary blade 20 of a clipper bladeset 22.

Figure 5:
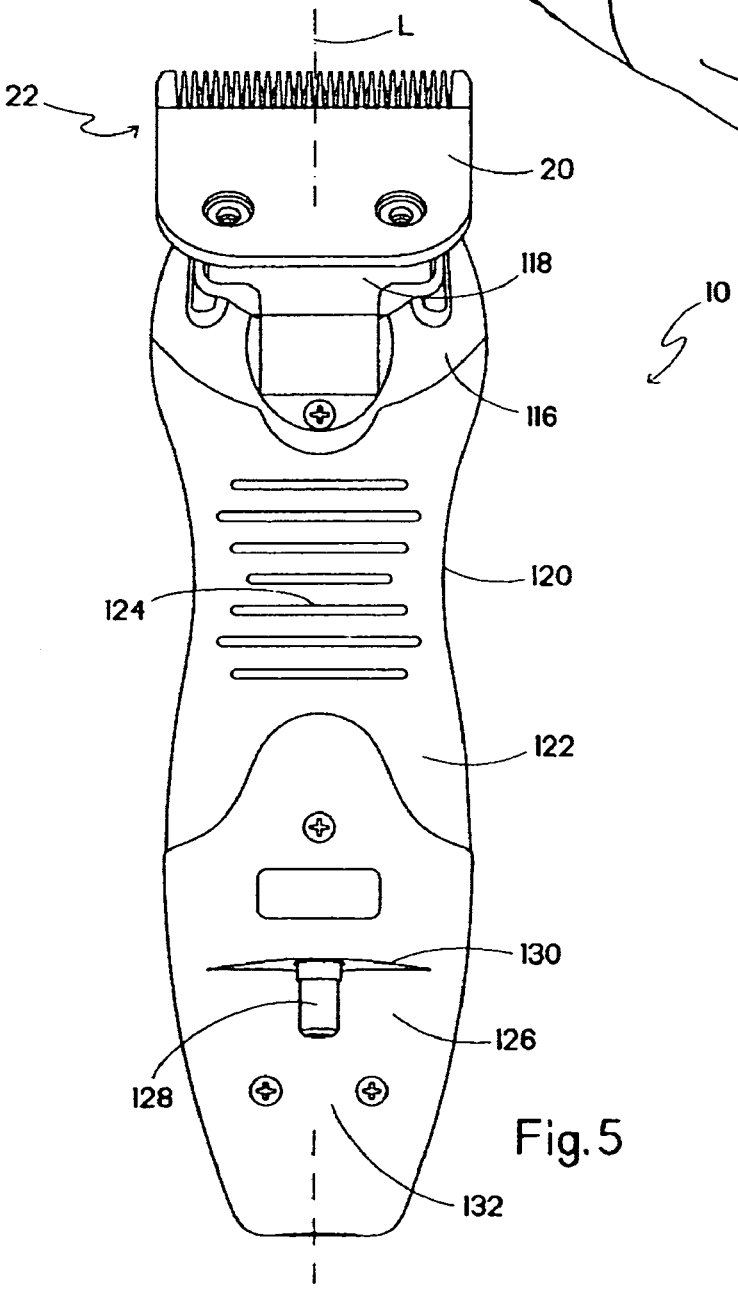
FIG. 5 is a bottom plan view of the clipper of FIG. 4.

The bladeset 22 typically includes a biasing element 24 in the form of a spring which causes the moving blade 18 to be slidingly biased against the stationary blade 20 for more effective cutting action. In the present embodiment, the moving blade 18 defines a drive recess 26 (shown hidden) for receiving a blade engagement or driving tip 28 of a driving member 30. A feature of the present hair clipper is a drive system, generally designated 32, which moves the driving member 30 in a true linear fashion relative to the bladeset 22, so that the driving member moves linearly and reciprocally along an axis 'T' transverse to a longitudinal axis 'L' of the clipper 10 (FIG. 5). The reciprocating movement of the driving member 30 is parallel to the movement of the moving blade 18.

Referring now to FIGS. 1 and 2, the drive system 32 includes a chassis 34 mounted to the motor housing 16, as by suitable fasteners 36 and having a base plate 38 and a pair of spaced, generally parallel, normally projecting arms 40. The chassis 34 is preferably unitary, however multi-component chassis are also contemplated. A central opening 42 in the base plate 38 accommodates passage of the output shaft 14, and each of the arms 40 has a throughbore 44 dimensioned for receiving a respective end of a linear drive shaft 46. The drive shaft 46 is oriented to be parallel to the operational axis of the moving blade 18 and defines an operational path for the driving member 30. While the drive shaft 46 is preferably unitary, multiple component shafts are also contemplated. One end 48 of the drive shaft 46 is splined and is secured in a friction fit into the corresponding throughbore 44*a*.

Referring now mainly to FIG. 2, to facilitate linear sliding of the driving member 30 upon the drive shaft 46, the driving member includes a transverse throughbore 50 defined by opposing sidewalls 52. At least one and preferably two drive shaft bushings 54 preferably made of high wear-resistant material, are slidable upon the drive shaft 46 on an inner diameter, and are slidingly received in the throughbore 50 on an outer diameter.

In the driving member 30, the throughbore 50 is preferably located in a central shoulder portion 56. Projecting from the shoulder portion 56 is an elongate neck or gooseneck 58 having at its end 60 the preferably removable driving tip 28. The tip 28 has a radiused end 62 for reducing friction with the moving blade 18. A rear end 64 of the tip 28 defines a socket for receiving the end 60. Optional locking formations such as lugs 66 and openings or recesses 68 facilitate the attachment of the tip 28 upon the gooseneck end 60. The arched configuration of the gooseneck 58 provides an efficient angle of attack of the tip 28 into the moving blade 18.

Extending opposite from the gooseneck 58 is a cage 70 defined in part by the sidewalls 52 and also by upper and lower track members 72, 74. The sidewalls 52, the upper and lower track members 72, 74 and the shoulder portion 56 collectively define a drive chamber 76 within the cage 70. An upper opening 78 provides access to the cage 70 by a cam follower 80. Having spaced walls 82 separated by a back wall 84, the cam follower 80 defines the lateral throw or stroke of a bearing 86 rotatably engaged on a cam lug or pin 88 of an eccentric cam 90. The cam follower 80 also retains the bearing 86, preferably a ball bearing, high wear-resistant sleeve bushing or the like, within the cage 70. As is known in the art, the cam 90 is matingly engaged onto the output shaft 14 and rotates therewith. The cam follower 80, preferably made of high wear-resistant material, is also preferably held in place in the drive chamber 76 by a snap fit engagement achieved between a tab 92 on the shoulder portion 56 and a generally rectangular latch bracket 94. The specific configuration of the attachment of the cam follower 80 in the drive chamber 76 may vary to suit the application, and among other things, threaded fasteners are contemplated for alternative attachment devices.

To prevent relative pivoting of the driving member 30 and the chassis 34, a sleeve 96 is rotatably and coaxially engaged upon the eccentric cam 90. The sleeve 96, preferably made of high wear-resistant material, is held in position between the motor housing 16 and the cam lug 88 by a radially projecting annular ring 98 on the cam 90. Upon assembly of the drive system 32, the sleeve 96 rotates along the upper and lower track members 72, 74, thus supporting the cage 70, preventing pivoting action and maintaining the linear movement of the driving member 30 along the linear drive shaft 46.

In operation, as the motor output shaft 14 turns under power from the motor 12, the eccentric lug 88 and its affixed bearing 86 follow an eccentric path defined by the spaced walls 82 of the cam follower 80. This linear reciprocating movement pushes the bearing 86 against the cam follower 80, which causes the cage 70, and the driving member 30, to move laterally along the linear drive shaft 46. In this manner, true linear motion is provided, without an arcuate component.

Figure 3:
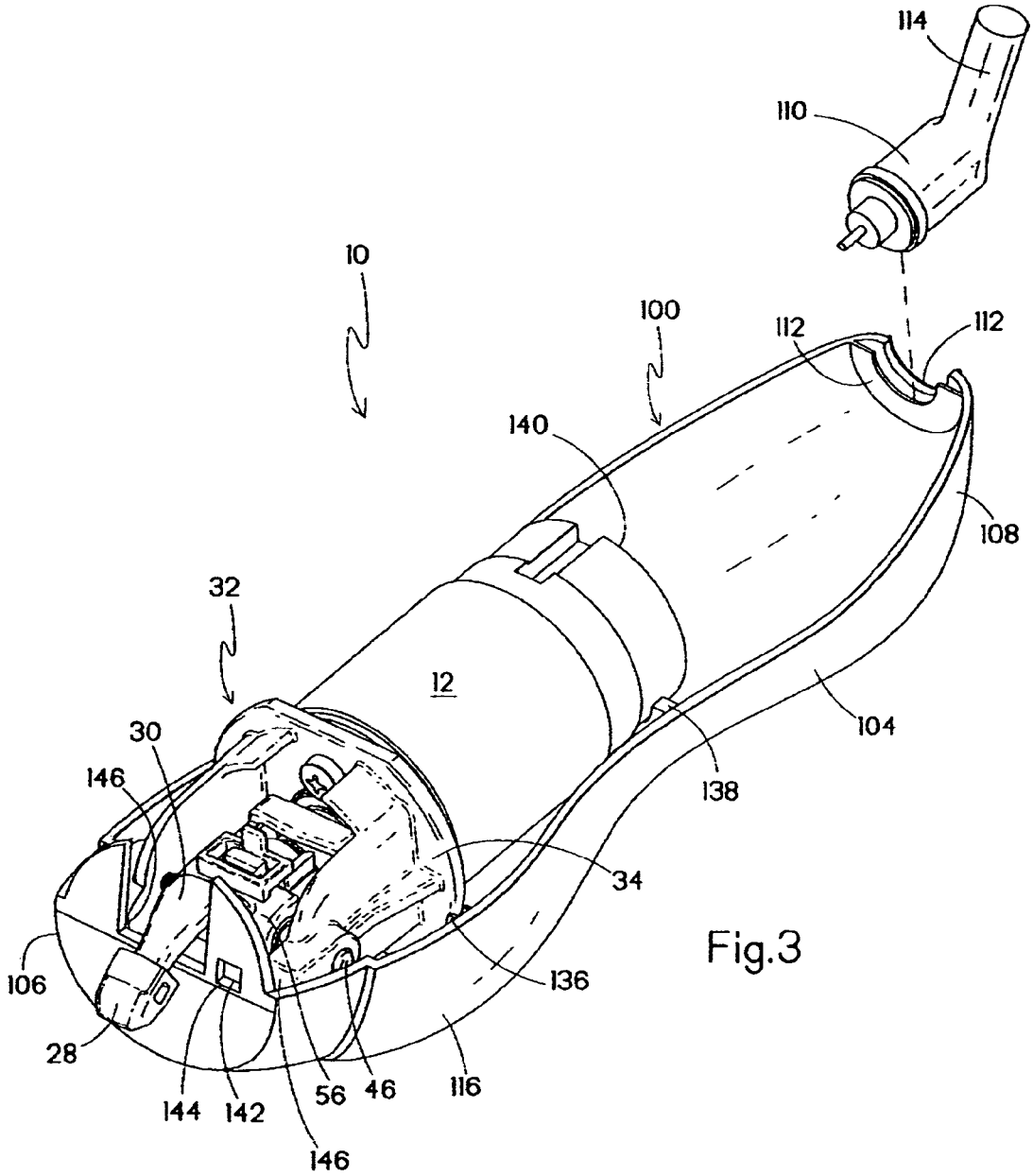
FIG. 3 is a fragmentary top perspective view of a hair clipper equipped with the present drive system and showing a cord protector exploded from the housing.
Figure 4:
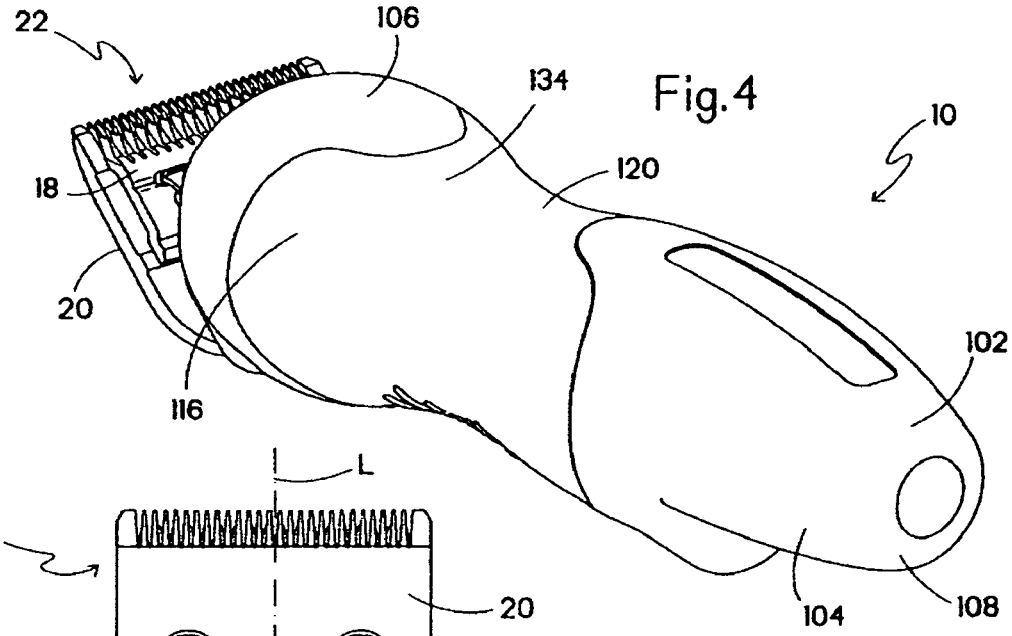
FIG. 4 is a side perspective view of a clipper provided with the present housing.
Figure 6:
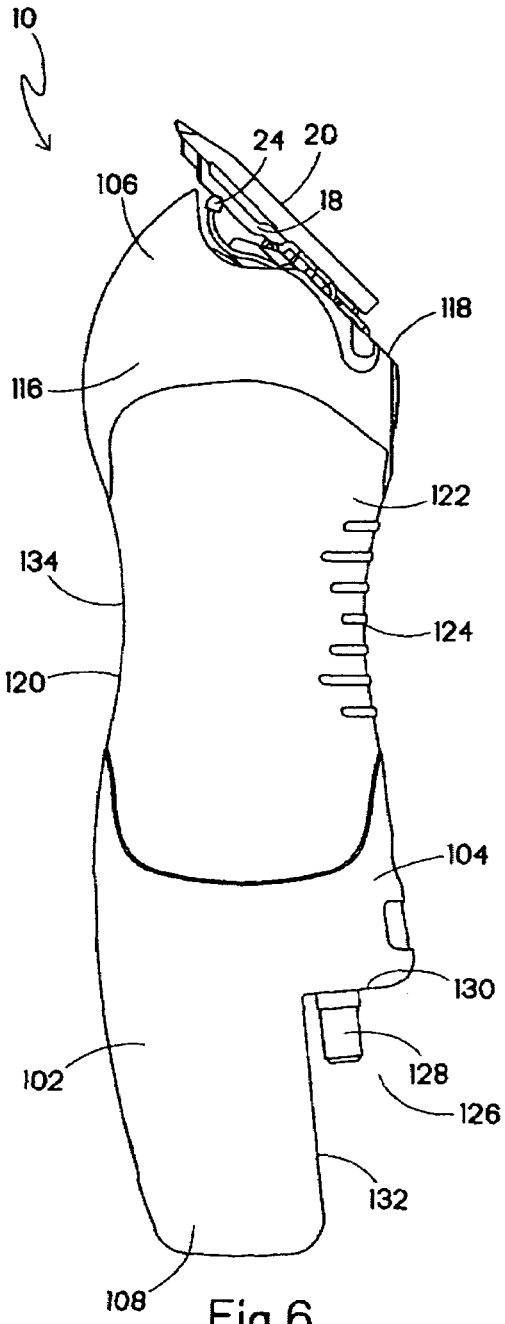
FIG. 6 is a side elevation of the clipper of FIG. 4.
Figure 7:
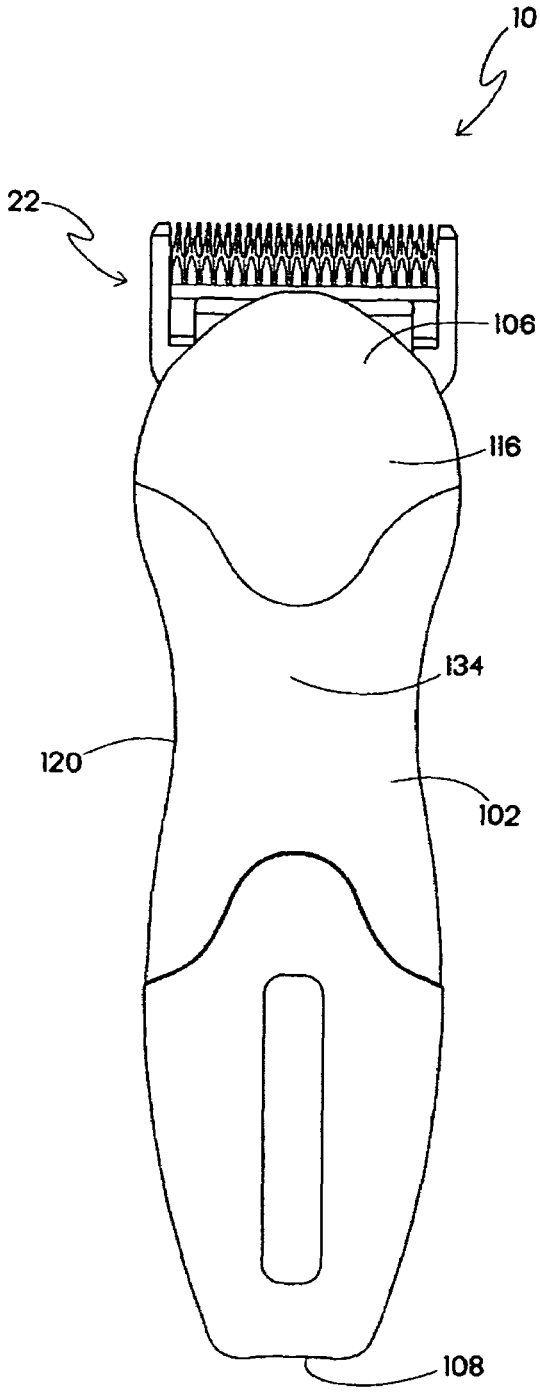
FIG. 7 is an overhead plan view of the clipper of FIG. 4.

Referring now to FIG. 3, the present drive system 32 and the motor 12 are held within a housing generally designated 100, including upper and lower housing halves 102, 104 best seen in FIG. 6). An advantage of the present clipper 10 is that the drive system 32 is easily placed as a unit within the housing 100. The housing 100 includes a bladeset end 106 and an opposite cord end 108. At the cord end 108, a rotatable cord protector 110 is rotatably secured between spaced "C"-ribs 112 in each housing half 102, 104. As such, a power cord (not shown) passing through a passageway 114 in the cord protector 110 prevent crimping or other stress on the power cord where it meets the housing 100.

Referring now to FIGS. 4-7, another feature of the present clipper 10 is that the drive system 32 is enclosed within a spheroidal or ball-shaped portion 116 of the housing 100. An advantage of the configuration of the spheroidal portion 116, which is located adjacent or in close operational proximity to the bladeset 22, is that during operation of the clipper 10, hair clippings do not accumulate in and around the bladeset, and are more apt to fall away from the housing 100. This advantage facilitates movement of the hair clipper 10 through the subject's hair, especially when the subject is an animal being clipped or shorn.

It will be seen from FIGS. 4-7 that the spheroidal portion 116 is generally smoothly radiused except for a generally planar surface 118 (FIG. 6) against which the bladeset 22 is mounted using a snap bracket (not shown) in a conventional manner well known in the art. The spheroidal portion 116 is separated from the cord end 108 by a relatively narrowed waist portion 120 shaped for ease of gripping by a user. An underside 122 of the housing 100 at the waist portion 120 is preferably provided with a gripping formation 124 for facilitating a positive grip by the user. In the preferred embodiment, the gripping formation 124 is a plurality of spaced, parallel ribs, however other types of grip-enhancing formations are contemplated, including but not limited to checkering and relatively more resilient rubberized parts.

As best seen in FIGS. 5 and 6, the underside 122 at the cord end 108 is provided with an angular undercut or recess 126 having a general "L"-shape when viewed from the side. A motor control switch actuator handle 128 projects from a short wall 130 of the recess 126 so that the handle extends along, and beneath, a longer wall 132. The length of the handle 128 may vary with the application. In this manner, when the clipper 10 is held by a user with the palm of the hand along an upper housing surface 134, it is more difficult to accidentally turn off the clipper during use, or turn on the clipper when such action is not desired. It is also preferred that the handle 128 is disposed within the user's grip range of the gripping formation 124, so that a user can actuate the handle 128 with one finger without releasing the grasp of the clipper 10 in the operational position, represented by the gripping formation.

Referring again to FIG. 3, another feature of the present clipper 10 is that the drive system 32 and the motor 12 are vibrationally isolated from the housing 100 by relatively resilient supporting ribs 136, 138, found respectively at the chassis 34, and supporting a rear end 140 of the motor 12.

Preferably, the resilient supporting ribs 136, 138 are found on both upper and lower housing halves 102, 104 and are made of a rubber-like material which has greater shock absorbing properties than the more rigid material used for the housing halves. The supporting ribs 136, 138 are constructed and arranged so that when the housing 100 is assembled, the ribs substantially encircle the respective chassis 34 and the motor 12. By isolating the chassis 34 and the motor 12 from the housing 100, both vibration and operational noise are reduced. To further reduce vibration and noise, gaskets 142 are disposed in openings 144 through which ends 146 of the chassis arms 40 project to mount to the bladeset 22 or a bladeset support bracket (not shown). The gaskets 142 are preferably made of the same resilient material as are the supporting ribs 136, 138, however other materials are contemplated.

While a particular embodiment of the present rotary motor clipper with linear drive system has been described herein, it will be appreciated by those skilled in the art that changes and modifications may be made thereto without departing from the invention in its broader aspects and as set forth in the following claims.

The invention claimed is:

1. A hair clipper, comprising:

a motor with a rotary output shaft;

a bladeset including a stationary blade and a moving blade configured for reciprocation relative to said stationary blade;

a drive system configured for transferring motion from said output shaft to said bladeset, and including a driving member separately formed from said moving blade and moving linearly along an axis transverse to a longitudinal axis of said clipper; and said drive system includes a linear drive shaft and said driving member is slidable relative to a generally U-shaped chassis, ends of said drive shaft are received in corresponding arms of said chassis, said drive system is configured so that said driving member reciprocates parallel to said moving blade throughout a stroke of said driving member;

said driving member being linearly slidable along an axis defined by said linear drive shaft extending transverse to said output shaft to provide linear motion of said moving blade relative to said stationary blade, said drive member being pivotable about said axis and having a cage with an opening facing said output shaft and configured for capturing a bearing eccentrically rotating about said output shaft, said cage capturing a non-eccentric portion of said output shaft to prevent pivoting action about said axis.

2. The clipper of claim 1 further including a throughbore and at least one bushing configured for slidably accommodating said drive shaft.

3. The clipper of claim 1 wherein said chassis is mountable on said motor.

4. The clipper of claim 1 wherein said drive system includes a linear drive shaft and said driving member includes a throughbore slidably engageable on said shaft and at least one bushing configured for engagement in said throughbore and dimensioned for slidably accommodating said drive shaft.

5. The clipper of claim 4 wherein said drive system is configured for moving said driving member linearly and reciprocally upon said drive shaft.

6. The clipper of claim 1 wherein said drive system includes an eccentric cam fixed to said output shaft and having a cam lug, said bearing affixed to said cam lug, and said cage configured for encompassing and retaining said bearing in a reciprocal travel path defined by a stroke of said cam lug.

7. The clipper of claim 6 wherein said driving member is provided with a blade engagement tip, and said cage is opposite said tip.

8. The clipper of claim 7 further including a cam follower insertable into said cage for maintaining said bearing in said cage.

9. The clipper of claim 8 wherein said cam follower is securable to said drive member.

10. The clipper of claim 6 further including a sleeve engageable on said eccentric cam and accommodated by a rear end of said cage for preventing pivoting action of said driving member relative to said drive shaft.

11. The clipper of claim 1 wherein said driving member includes a neck with a replaceable actuator tip for engaging said bladeset.

12. The clipper of claim 1 further including a housing and wherein said drive system is enclosed within a spheroidal portion of said housing disposed directly adjacent said moving blade of said bladeset in a fixed position relative to said moving blade and defining a spheroidal flow path for cut hair for promoting flow of cut hair away from said bladeset.

13. The clipper of claim 1 further including a housing and a rotatable cord protector disposed in said housing.

14. The clipper of claim 1 further including a housing defining an underside and said clipper further includes a motor control switch with a handle projecting from said underside in an area within reach of a user's hand position.

15. The clipper of claim 1 further including a housing having at least one resilient supporting rib for vibrationally isolating said housing from said motor and said drive system.

16. A hair clipper, comprising:

a motor with a rotary output shaft;

a bladeset including a stationary blade and a moving blade configured for reciprocation relative to said stationary blade;

a drive system configured for transferring motion from said output shaft to said bladeset, and including a driving member moving linearly along an axis transverse to a longitudinal axis of said clipper; and said drive system includes a linear drive shaft and said driving member being linearly slidable along an axis defined by said shaft to provide linear motion of said moving blade relative to said stationary blade, an eccentric cam fixed to said output shaft and having a cam lug, a bearing affixed to said cam lug, said drive member being pivotable about said axis and having a cage configured for encompassing and retaining said bearing associated with said output shaft in a reciprocal travel path defined by a stroke of said cain lug to prevent pivoting action about said axis; and a sleeve engageable on said eccentric cam and accommodated by a rear end of said cage for preventing pivoting action of said driving member relative to said drive shaft.

* * * * *